US009174333B2

(12) United States Patent
Rubin et al.

(10) Patent No.: US 9,174,333 B2
(45) Date of Patent: Nov. 3, 2015

(54) PORTABLE TOOL

(71) Applicant: InterDesign, Inc., Solon, OH (US)

(72) Inventors: Bennett S. Rubin, Pepper Pike, OH (US); Richard C. Adamany, Chagrin Falls, OH (US); Aaron Marshall, Uniontown, OH (US)

(73) Assignee: InterDesign, Inc., Solon, OH (US)

( * ) Notice: Subject to any disclaimer, the term of this patent is extended or adjusted under 35 U.S.C. 154(b) by 191 days.

(21) Appl. No.: 13/742,840

(22) Filed: Jan. 16, 2013

(65) Prior Publication Data

US 2013/0180053 A1 Jul. 18, 2013

Related U.S. Application Data

(60) Provisional application No. 61/586,905, filed on Jan. 16, 2012.

(51) Int. Cl.

| | |
|---|---|
| ***B25F 1/04*** | (2006.01) |
| ***B25B 27/00*** | (2006.01) |
| ***B25G 1/08*** | (2006.01) |

(52) U.S. Cl.

CPC ..... *B25F 1/04* (2013.01); *B25B 27/0071* (2013.01); *B25G 1/085* (2013.01)

(58) Field of Classification Search

CPC ..... B25F 1/04; B25G 1/085; B25B 27/0071
USPC ..... 81/440, 177.4, 490; 7/118, 168, 165
See application file for complete search history.

(56) References Cited

U.S. PATENT DOCUMENTS

| | | | | |
|---|---|---|---|---|
| D238,436 | S | 1/1976 | McKelvey | |
| 4,570,341 | A * | 2/1986 | Konneker | 7/118 |
| 5,388,824 | A | 2/1995 | Reimers | |
| 5,491,856 | A * | 2/1996 | Legg | 7/128 |
| 5,553,340 | A * | 9/1996 | Brown, Jr. | 7/118 |
| 5,759,120 | A | 6/1998 | Mathis et al. | |
| D438,086 | S | 2/2001 | Ahlund | |
| D440,141 | S | 4/2001 | Yeh | |
| 6,273,582 | B1 | 8/2001 | Taggart et al. | |
| D477,509 | S | 7/2003 | Allen et al. | |
| 6,837,807 | B1 | 1/2005 | Kerr | |
| D514,063 | S | 1/2006 | Rubin et al. | |
| D514,512 | S | 2/2006 | Rubin et al. | |
| D525,247 | S | 7/2006 | Rubin et al. | |
| 7,125,145 | B2 | 10/2006 | Gardiner et al. | |
| D551,802 | S | 9/2007 | Rubin et al. | |
| D555,455 | S | 11/2007 | Cheng | |
| D564,387 | S | 3/2008 | Rubin et al. | |
| D575,182 | S | 8/2008 | Rubin et al. | |
| D593,693 | S | 6/2009 | Adamany et al. | |

(Continued)

*Primary Examiner* — Hadi Shakeri
(74) *Attorney, Agent, or Firm* — Calfee, Halter & Griswold LLP

(57) ABSTRACT

The present application discloses a portable tool. In one embodiment, the portable tool comprises a body portion, a tool portion, and an attachment member for fastening the portable tool to a second device. The tool portion is coupled to the body portion and has one or more tools. The tool portion is configured to rotate about an axis of rotation and relative to the body portion. The attachment member is operatively coupled to the tool portion and rotates with the tool portion about the axis of rotation and relative to the body portion. Rotating the tool portion relative to the body portion exposes a space between the attachment member and the tool portion that permits release of the second device from the portable tool.

17 Claims, 8 Drawing Sheets

(56) References Cited

U.S. PATENT DOCUMENTS

| | | | | |
|---|---|---|---|---|
| 7,557,720 | B2 | 7/2009 | Rubin et al. | |
| D598,266 | S | 8/2009 | Rubin et al. | |
| D603,239 | S | 11/2009 | Kunzendorf | |
| 7,810,415 | B2 * | 10/2010 | Adamany et al. | 81/440 |
| D630,486 | S | 1/2011 | Rubin et al. | |
| D645,722 | S | 9/2011 | Yamaguchi | |
| 8,074,541 | B2 | 12/2011 | Adamany et al. | |
| D657,650 | S | 4/2012 | Rubin et al. | |
| D657,651 | S | 4/2012 | Rubin et al. | |

* cited by examiner

PORTABLE TOOL

CROSS REFERENCE TO RELATED CASES

The present application claims priority to, and any other benefit of, U.S. Provisional Patent Application No. 61/586,905, filed Jan. 16, 2012, and is related to U.S. Design Patent Application Serial No. 29/411,029, filed Jan. 16, 2012, and entitled HANDHELD TOOL, the entire disclosures of which are fully incorporated herein by reference.

FIELD OF THE INVENTION

The present invention relates generally to a portable tool device and methods of using a portable tool device.

BACKGROUND

Tool kits are known for many different purposes. For example, portable tool kits exist for repairing bicycles or repairing tires. Some conventional tool kits have one or more tools that are housed within a body of the tool kit. In some instances, the tool kits are configured to be attached to a key ring or a key chain.

SUMMARY

The present application discloses a portable tool and methods of using a portable tool. In one embodiment, the portable tool comprises a body portion, a tool portion, and an attachment member for fastening the portable tool to a second device. The tool portion is coupled to the body portion and has one or more tools. The tool portion is configured to rotate about an axis of rotation and relative to the body portion from a first position in which the tool portion is stored within a cavity of the body portion to a second position in which the longitudinal axis of the tool portion is substantially parallel to the longitudinal axis of the body portion. The attachment member is operatively coupled to the tool portion and rotates with the tool portion about the axis of rotation and relative to the body portion. Rotating the tool portion relative to the body portion exposes a space between the attachment member and the tool portion that permits release of the second device from the portable tool.

DETAILED DESCRIPTION

The present application discloses a portable tool device. The portable tool generally comprises a body portion and a tool portion rotatably coupled to the body portion. The body portion functions as a handle of the portable tool and the tool portion generally comprises one or more tools, such as, for example, a screwdriver, knife, ice pick, can opener, bottle opener, nail file, flashlight, corkscrew, scissors, hook, cigar cutter, pliers, wrench, divot repair tool, USB device, or the like. The portable tool is configured such that the tool portion rotates relative to the body portion from a retracted or stored position to an extended or use position. The tool portion is operatively coupled to an attachment member for fastening the portable tool to second device, such as, for example, a key ring, another tool, an article of clothing, a set of keys, or the like. The attachment member is operatively coupled to the tool portion such that it rotates with the tool portion and relative to the body portion. Rotating the tool portion relative to the body portion exposes a space between the attachment member and the tool portion that permits release of the portable tool from the second device.

Figure 1C:
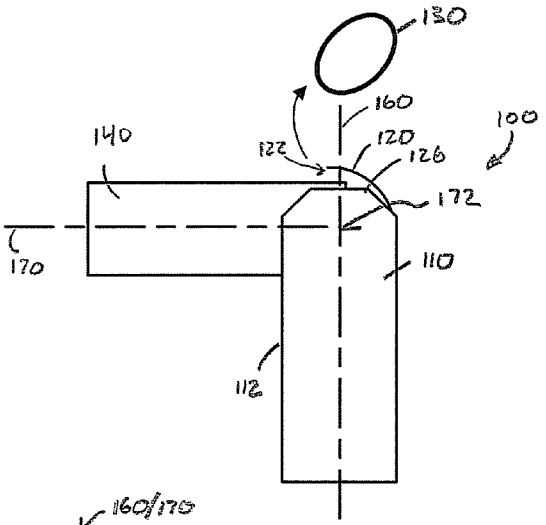
FIGS. 1A-1E illustrate a portable tool according to an embodiment of the present application.
Figure 1E:
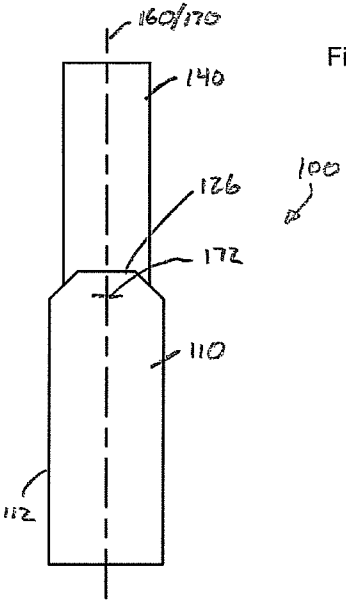
Figure 1B:
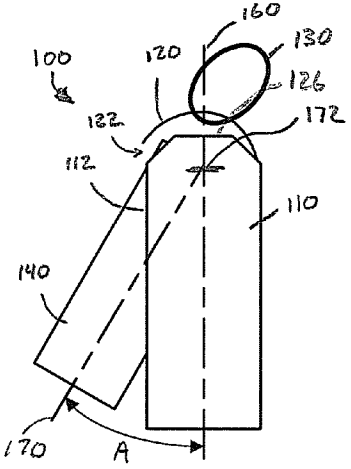
Figure 1D:
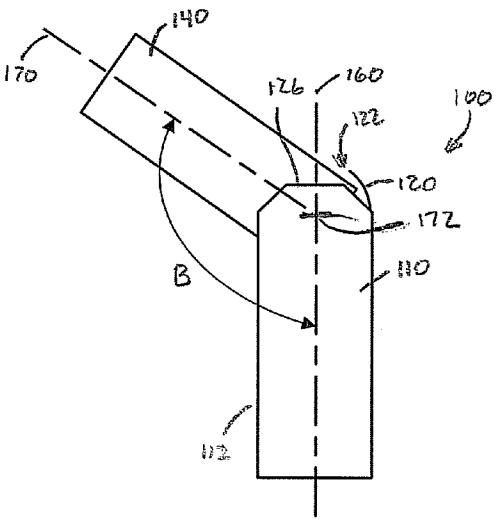
Figure 1A:
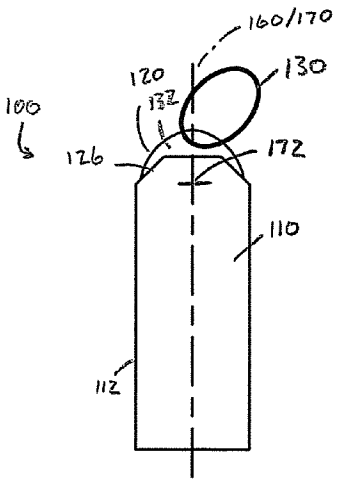

FIGS. 1A-1E illustrate a portable tool device 100 according to an embodiment of the present application. Furthermore, FIGS. 1A-1E illustrate the rotation of a tool portion 140 relative to a body portion 110 of the portable tool 100. FIG. 1A illustrates the tool portion 140 in a retracted position. In the retracted position, the tool portion 140 is stored in a cavity of the body portion 110 or handle of the portable tool 100.

As illustrated in FIG. 1A, the longitudinal axis 170 of the tool portion 140 is substantially parallel to and aligned with the longitudinal axis 160 of the body portion 110 when the tool portion is in the retracted position. The tool portion 140 is configured to be rotated relative to the body portion 110 and out of the cavity in the body portion to expose the tool portion. The rotation of the tool portion 140 may be manual, assisted (e.g., a biased member such as a spring assists rotation of the tool portion 140 out of the body portion 110 and then the tool portion 140 is manually further rotated into position) or automatic (e.g., a biased member such as a spring rotates the tool portion 140 out of the body portion 110 and into a working position). The tool portion 140 rotates about an axis of rotation 172. FIGS. 1B-1E illustrate the rotation of the tool portion 140 in a clockwise direction relative to the body portion 110 and about the axis of rotation 172. An opening in a first longitudinal side 112 and proximal end 126 of the body portion 110 provides access for the tool portion 140 to rotate in and out of the cavity of the body portion and between the retracted and extended positions. The tool portion 140 of FIGS. 1A-1E may be rotated approximately 180 degrees from the retracted position shown in FIG. 1A to the extended position shown in FIG. 1E. In other embodiments, the tool portion might be rotated only approximately 90 degrees into a working position.

Figure 2C:
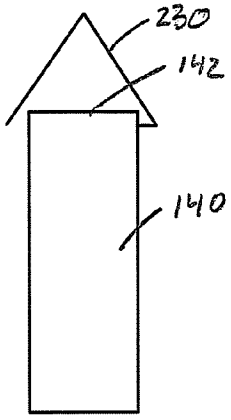
FIGS. 2A-2E illustrate various tool portions and attachment members of a portable tool according to other embodiments of the present application.
Figure 2E:
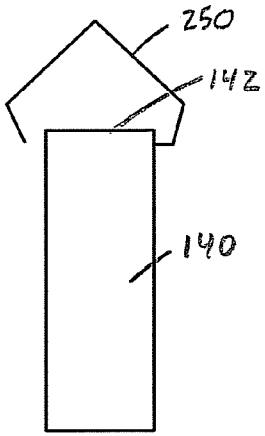
Figure 2B:
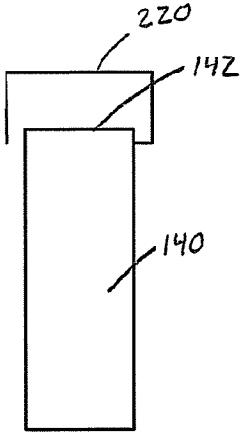
Figure 2D:
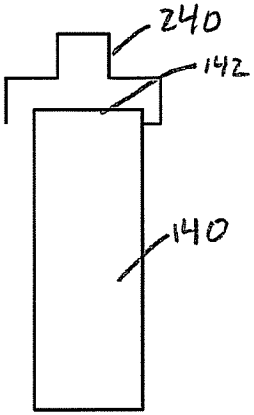
Figure 2A:
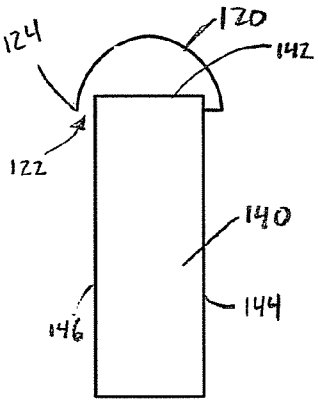

As illustrated in FIGS. 1A-1D and 2A, an attachment member 120 is operatively coupled to the tool portion 140 and is configured such that at least a portion of the attachment member extends outward from the tool portion 140 proximate the end of the tool portion rotatably coupled to the body portion 110. The attachment member 120 is configured to rotate with the tool portion 140 and about the axis of rotation 172. As illustrated in FIG. 2A, the attachment member 120 is a curved member that at least partially circumferentially surrounds a proximal end 142 of the tool portion 140. As shown, the attachment member 120 extends outward from a first longitudinal side 144 of the tool portion 140 and then curves upward to circumferentially surround the proximal end 142 of the tool portion. The attachment member 120 is shaped and configured to provide a space 122 between a distal end 124 of the attachment member and a second longitudinal side 146 of the tool portion 140. Furthermore, in some embodiments, the attachment member 120 may be flexible and/or resilient such that the distal end 124 of the attachment member may be temporarily moved away from the second longitudinal side 146 of the tool portion 140 to increase the space 122 and facilitate removal of the second device 130.

The attachment member of the present application may be a variety of shapes and sizes and have one or more sides. For example, as illustrated in FIGS. 2A-2E, the attachment member may be shaped as a partial circle or ellipse 120, square or rectangle 220, triangle 230, cross 240, pentagon 250, or the like that at least partially circumferentially surrounds a proximal end 142 of the tool portion 140.

Referring again to FIGS. 1A-1E, when the tool portion 140 is in the refracted position, the attachment member 120 extends outward from the body portion 110 and is accessible for fastening the portable tool 100 to a second device 130. The second device 130 is illustrated as a key ring in FIGS. 1A-1C, however a variety of other devices may be fastened to the portable tool 100. An opening 132 disposed between the attachment member 120 and the body portion 110 provides a space for fastening the portable tool 100 to the second device 130. As illustrated in FIG. 1A, the space provided by the opening 132 is bounded by the body portion 110 and the attachment member 120 such that the second device 130 is prohibited from coming unfastened from the portable tool 100. Furthermore, the opening 132 may be a variety of shapes and sizes (see, e.g., FIGS. 2A-2E) to permit fastening a variety of objects having different sizes and shapes to the portable tool 100.

As the tool portion 140 is rotated relative to the body portion 110, the space 122 between the attachment member 120 and the tool portion is exposed to permit removal of the second device 130 from the portable tool 100. As illustrated in FIG. 1B, the space 122 is exposed when the tool portion 140 is rotated at an angle A relative to the body portion 110. Angle A represents the angle between the longitudinal axis 170 of the tool portion 140 and the longitudinal axis 160 of the body portion 110 where the tip 124 of the attachment member 120 has moved sufficiently from the body portion to first permit removal of the second device 130 from the portable tool 100. Angle A might be between about 15 and 25 degrees. In one embodiment, angle A is about 20 degrees. In other embodiments, angle A is greater than 15 degrees, or greater than 30 degrees, or greater than 45 degrees, or greater than 60 degrees, or greater than 75 degrees, or greater than 90 degrees.

As illustrated in FIGS. 1B-1E, the attachment member 120 retracts into the body portion 110 or handle of the portable tool 100 as the tool portion 140 rotates relative to the body portion. As such, the exposed portion of the attachment member 120, or the portion of the attachment member that extends outward from the body portion 110, is decreased or made smaller as the tool portion 140 rotates relative to the body portion 110. As illustrated in FIGS. 1B-1E, the second device 130 is automatically released from the portable tool 100 as the exposed portion of the attachment member 120 is decreased. FIG. 1E illustrates the tool portion 140 in the extended position. When the tool portion 140 is in the extended position, the attachment member 120 is retracted into the body portion 110 such that it is substantially hidden by the body portion and the tip 124 is not gripped by a user while using the tool. As such, the second device 130 is prohibited from being fastened to the portable tool 100 when the tool portion 140 is in the extended position.

FIG. 1D illustrates the tool portion 140 rotated at an angle B relative to the body portion 110 which is just prior to the extended position shown in FIG. 1E. Angle B represents the angle between the longitudinal axis 170 of the tool portion 140 and the longitudinal axis 160 of the body portion 110 where the attachment member 120 has been exposed enough that the second device 130 can be positioned into the space 122, e.g., by hanging onto the tip 122 of attachment member 120. Angle B might be between about 155 and about 165 degrees. In one embodiment, angle B is about 160 degrees. In other embodiments, angle B is greater than 150 degrees, or greater than 120 degrees, or greater than 90 degrees. Furthermore, when the tool portion 140 is rotated at angle B relative to the body portion 110, the exposed portion of the attachment member 120 is still large enough to begin fastening the second device 130 to the portable tool 100, e.g., by hanging the second device onto the tip 122 of attachment member 120 or holding it in the space 122 as the tool portion is further rotated back toward the base portion 110. However, when the tool portion 140 is rotated relative to the body portion 110 beyond this point at angler B, the exposed portion of the attachment member 120 is no longer large enough to begin fastening the second device 130 to the portable tool 100. As such, the portable tool 100 is configured such that the second device 130 may be automatically released from the portable tool when the tool portion 140 is rotated relative to the body portion 110 at any position between angle A and angle B. The difference between angle A and angle B represents a releasable range of the portable tool 100. For example, an angle A of about 20 degrees and an angle B of about 160 degrees provide a releasable range of about 140 degrees. The releasable range of the portable tool 100 may be between 30 degrees and 160 degrees, e.g., at least 30 degrees, at least 45 degrees, at least 60 degrees, at least 75 degrees, or at least 90 degrees, and also less than 160 degrees, less than 150 degrees, less than 140 degrees, less than 120 degrees, or less than 90 degrees (using any combination of these range endpoints, (e.g., a release range of at least 45 degrees and less than 150 degrees), and also using any combination of the A values and B values given above that mathematically provide that range).

Furthermore, the portable tool 100 is configured such that the second device 130 is released from the portable tool in a direction away from the movement of the tool portion 140 and the attachment member 120 relative to the body portion 110. As such, the rotation of the tool portion 140 relative to the body portion 110 does not interfere with the release of the second device 130.

The tool portion 140 comprises one or more tools that may be used when the tool portion is exposed. For example, when the tool portion 140 is in the extended position, the tools of the tool portion are accessible and exposed for use. However, the tools of the tool portion 140 may be used when the tool portion is at any angle relative to the body portion 110 and the tools of the tool portion are exposed for use. Furthermore, in the extended position, the tool portion 140 is orientated such that the longitudinal axis 170 of the tool portion is substantially parallel to and aligned with the longitudinal axis 160 of the body portion 110. As such, the tool portion 140 extends from an end of the body portion 110 or handle of the portable tool 100 such that the portable tool resembles other common tools, such as, for example, a screwdriver, knife, or other like. Furthermore, the body portion 110 of the portable tool 100 provides a rigid and sturdy handle for the user to grip when using the tools of the tool portion 140. In this regard, the portable tool 100 also has the feel of such common tools and is able to withstand the torque and prying forces applied to the handle of such tools. Virtually any of the tool portions (or subsets thereof) shown in U.S. Pat. Nos. 7,810,415; 8,074,541; D598,266; D593,693; and D630,486 (which are hereby incorporated by reference to the extent not conflicting with this application) may be used as the tool portion 140 for virtually any of the embodiments disclosed herein.

In some embodiments, the portable tool 100 comprises a user actuated locking mechanism for locking the tool portion 140 at any position relative to the body portion 110. For example, the locking mechanism may be configured to lock the tool portion 140 in the refracted position and/or in the extended position and/or at any position in between. Furthermore, the portable tool 100 may comprise a biasing mechanism, such as a leaf spring, that biases or moves the tool portion 140 out of the cavity of the body portion 110. For example, when the user actuates the locking mechanism to release the tool portion 140 from the retracted position, the biasing mechanism may bias or move the tool portion out of the cavity such that it is at least partially exposed. As such, a user of the portable tool 100 is able to easily grasp the tool portion 140 to rotate the tool portion relative to the body portion 110 and into the desired position. Furthermore, in some embodiments, at least a portion of the tool portion 140 is exposed in the retracted position such that it may be easily grasped by a user.

FIGS. 3A-8 illustrate a portable tool device 300 according to another embodiment of the present application. The portable tool 300 comprises a body portion 310 and a tool portion 540 rotatably coupled to the body portion. The body portion 310 functions as a handle of the portable tool 300. The portable tool 300 is configured such that the tool portion 540 rotates relative to the body portion 310 from a retracted or stored position illustrated in FIGS. 3A-4B to an extended or use position illustrated in FIGS. 6A-7B. The tool portion 540 is operatively coupled to an attachment member 320 for fastening the portable tool 300 to a second device 430, which is shown as a key ring in FIGS. 4A-5B, but may be a variety of other objects, such as, for example, another tool, an article of clothing, a set of keys, or the like. The attachment member 320 is operatively coupled to the tool portion 540 such that it rotates with the tool portion and relative to the body portion 310. Rotating the tool portion 540 relative to the body portion 310 exposes a space 522 (FIG. 5B) between the attachment member 320 and the tool portion that permits release of the second device 430 from the portable tool 300.

Figure 7A:
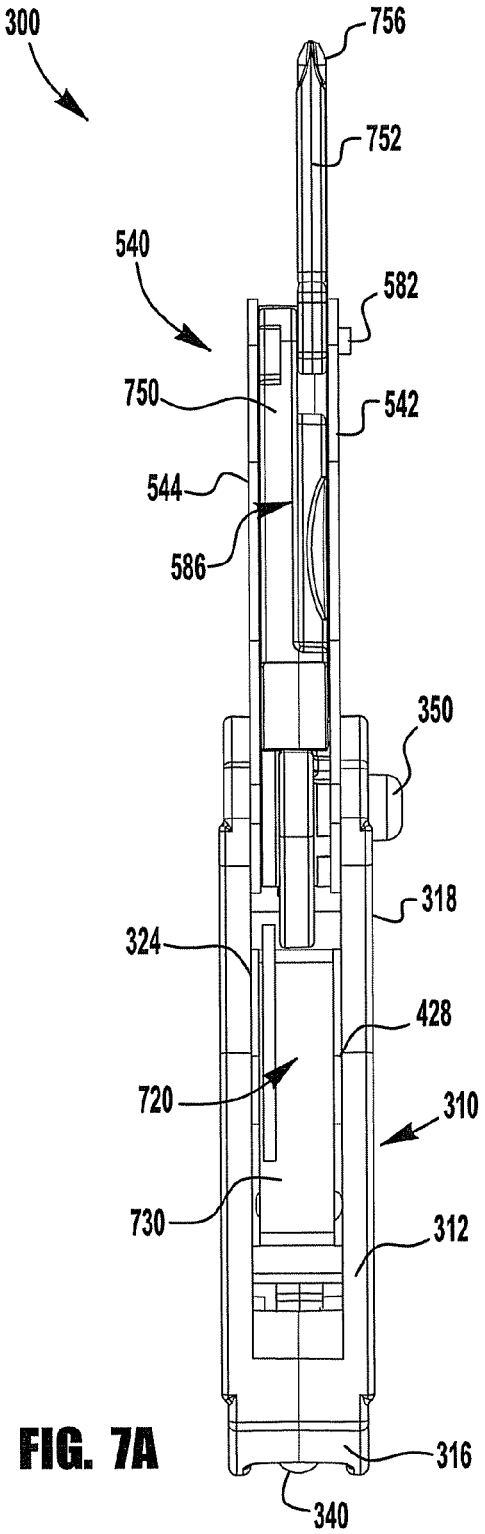
FIGS. 7A and 7B are side and front views of the portable tool shown in FIGS. 3A and 3B with tools of the tool portion in an extended position.
Figure 8:
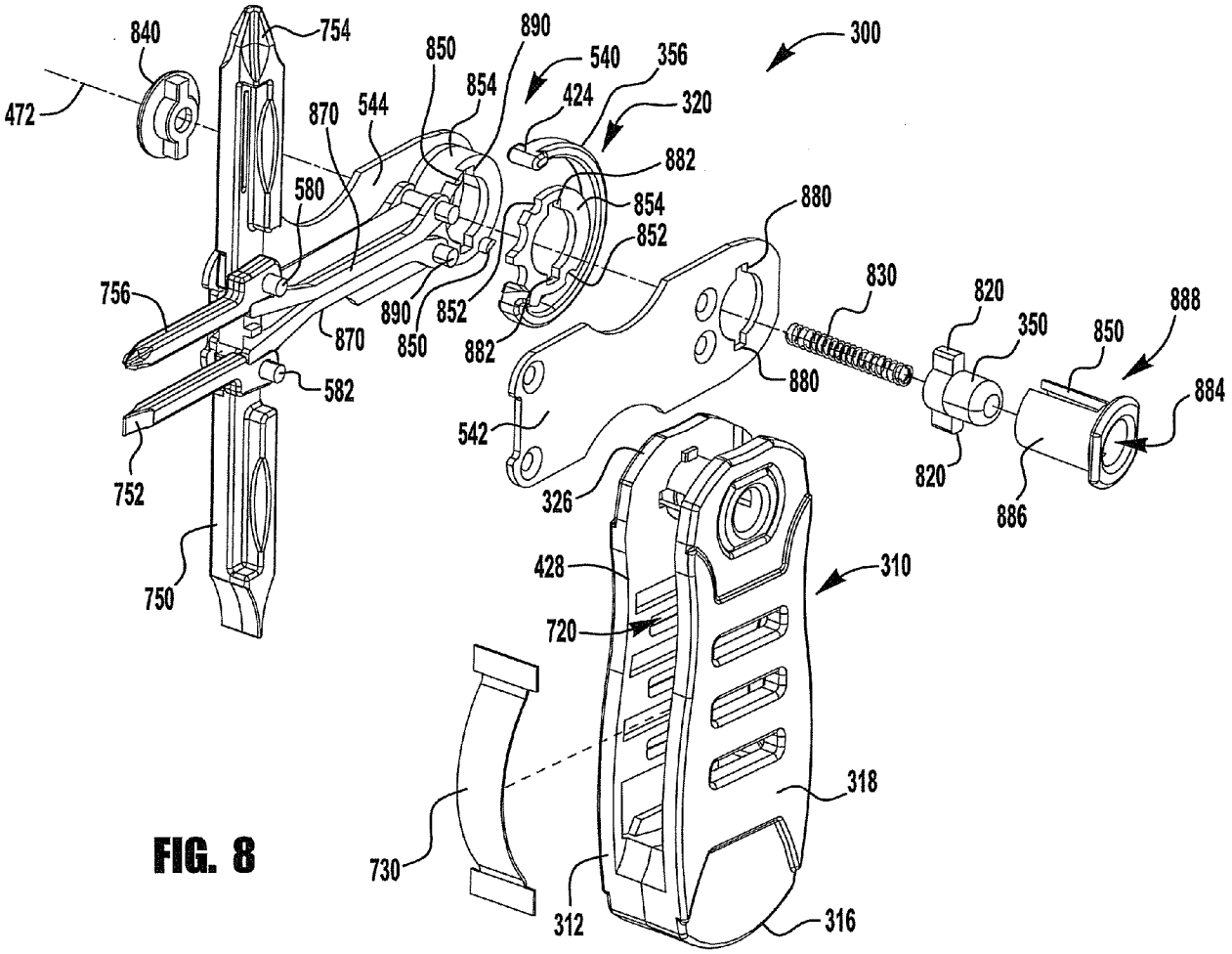
FIG. 8 is an exploded perspective view of the portable tool shown in FIGS. 3A and 3B.

FIGS. 3A-4B illustrate the tool portion 540 in the retracted position. In the retracted position, the tool portion 540 is stored in a cavity 720 (FIGS. 7A and 8) in the side of the body portion 310 or handle of the portable tool 300. In contrast, FIG. 5 of U.S. Pat. No. 8,074,541 shows a cavity in the top of, instead of the side of, the body portion. As illustrated in FIGS. 7A and 8, an opening 428 in a first longitudinal side 312 and proximal end 326 of the body portion 310 provides access for the tool portion 540 to rotate in and out of the cavity 720 and between the retracted and extended positions. Furthermore, as shown in FIGS. 3A-4B, the tool portion 540 is surrounded on at least four sides by the body portion 310 when the tool portion is stored within the body portion 310. A top face 318, bottom face 324, distal end 316, and second longitudinal side 314 of the body portion 310 surrounds the tool portion 540 when the tool portion is in the retracted position. As such, the tool portion 540 may be hidden from view when retracted within the body portion 310 of the portable tool 300. In contrast, in the tool shown in FIG. 5 of U.S. Pat. No. 8,074,541, the tool portion is protected only on three sides, i.e., the left and right sides and the distal end.

As illustrated in FIG. 8, the attachment member 320 comprises an inner portion 854 and an outer portion 356. The inner portion 854 operatively couples the attachment member 320 to the tool portion 540. A central member 854 of the tool portion 540 has one or more protrusions 850 that are received in one or more notches 852 of the inner portion 854. The inner portion 854 of the attachment member 320 is also disposed between the central member 854 and a first plate 542 of the tool portion 540. As such, the attachment member 320 rotates with the tool portion 540 and about the axis of rotation 472. In other embodiments, however, the attachment member and the tool portion may comprise one or more components integrally formed or otherwise combined such that the tool portion and the attachment rotate together.

The outer portion 356 of the attachment member 320 extends outward from the tool portion 540 proximate the end of the tool portion rotatably coupled to the body portion 310. As shown in FIGS. 3A-4B and 8, the outer portion 356 is a curved member that at least partially circumferentially surrounds a proximal end of the tool portion 540. As illustrated in FIG. 8, the outer portion 356 extends outward from the inner portion 854 of the attachment member 320 and then curves upward to circumferentially surround the proximal end of the tool portion 540. Furthermore, as illustrated in FIG. 5B, the outer portion 356 of the attachment member 320 is shaped and configured to provide a space 522 between a distal end 424 of the attachment member and a longitudinal side of the tool portion 540. In some embodiments, the attachment member 320 may be flexible and/or resilient such that the distal end 424 of the attachment member may be moved away from the longitudinal side of the tool portion 540 to increase the space 522 and facilitate removal of the second device 430.

Figure 4A:
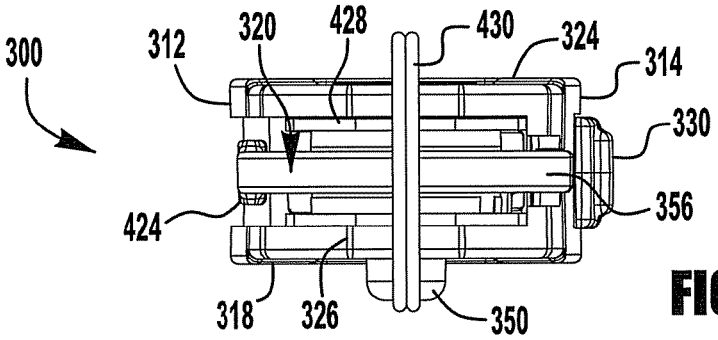
FIGS. 4A and 4B are top and front views of the portable tool shown in FIGS. 3A and 3B with a tool portion of the portable tool in a retracted position.
Figure 4B:
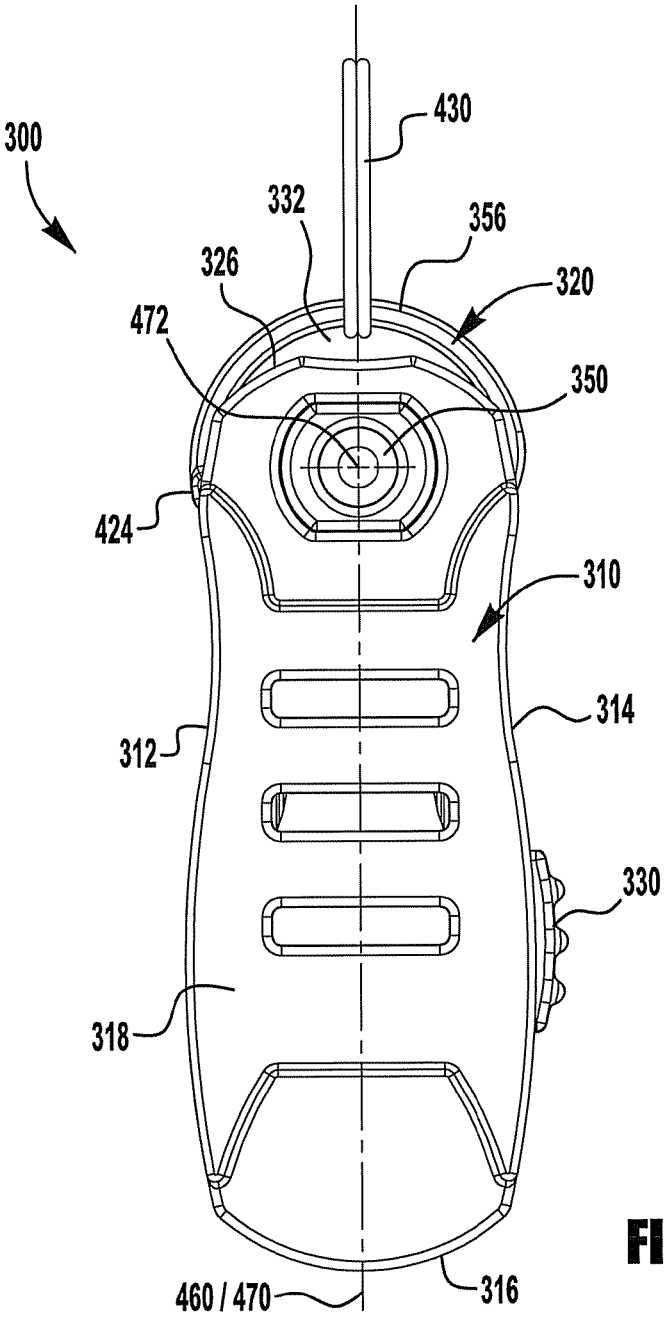
Figure 5A:
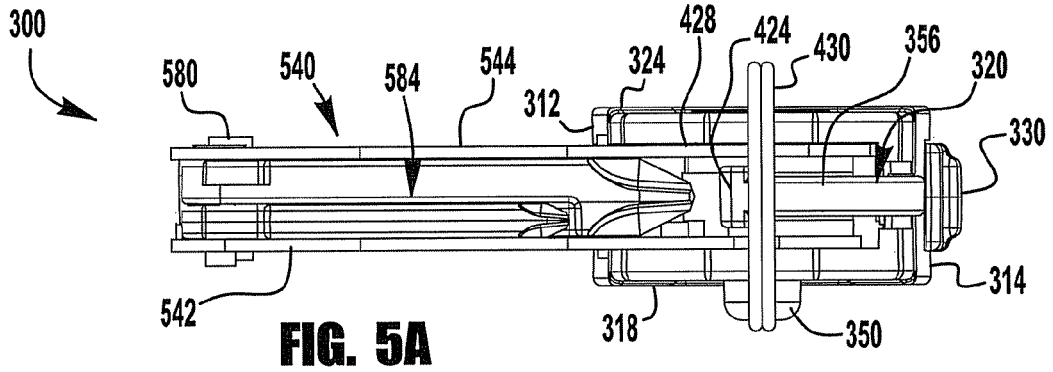
FIGS. 5A and 5B are top and front views of the portable tool shown in FIGS. 3A and 3B with the tool portion rotated relative to a body portion of the portable tool.
Figure 5B:
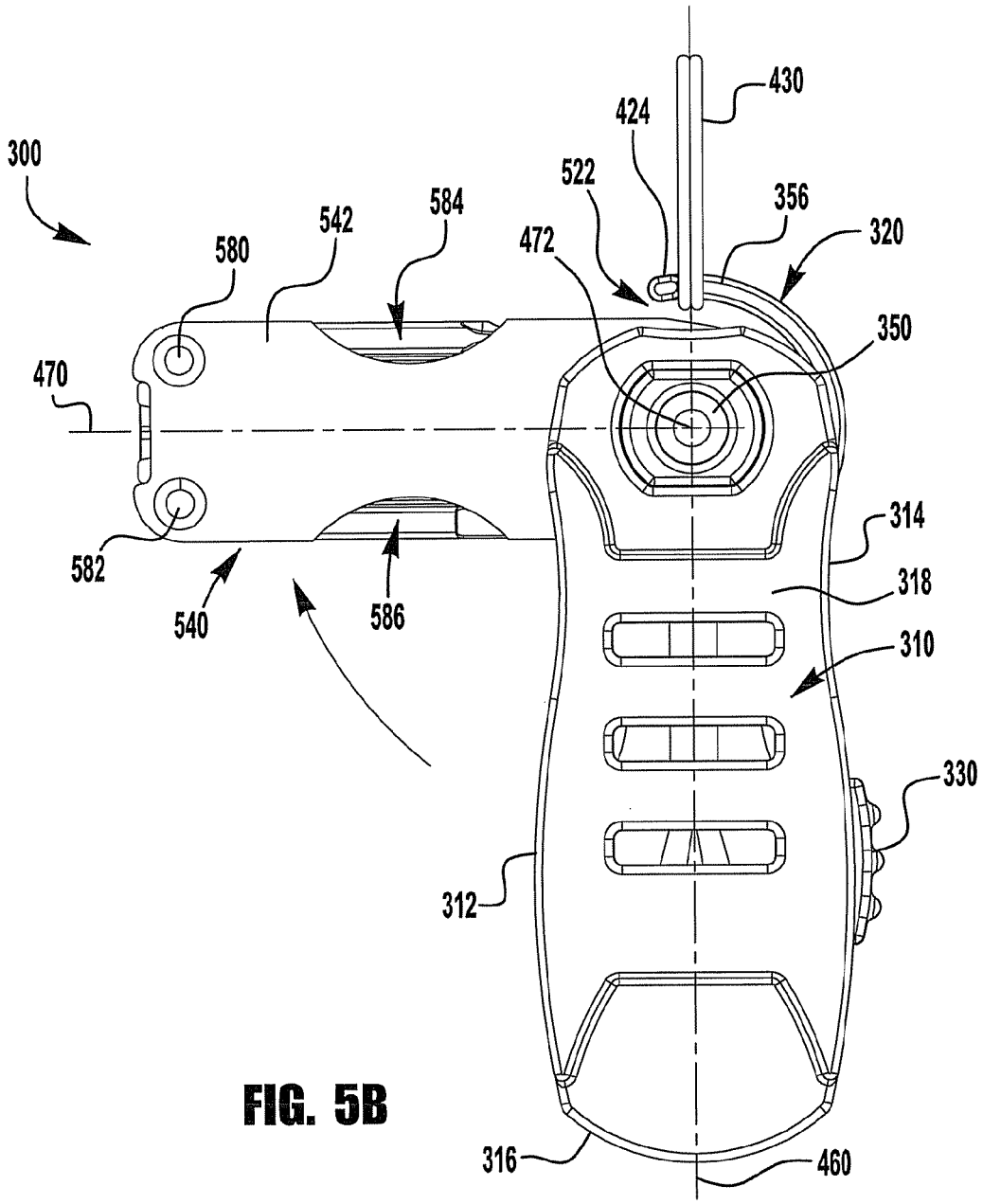
Figure 6A:
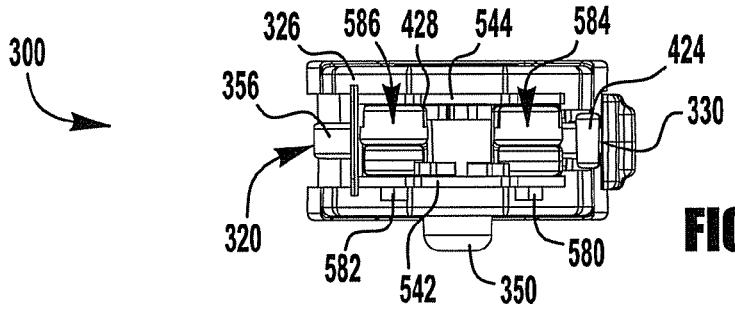
FIGS. 6A and 6B are top and front views of the portable tool shown in FIGS. 3A and 3B with the tool portion of the portable tool in an extended position.
Figure 6B:
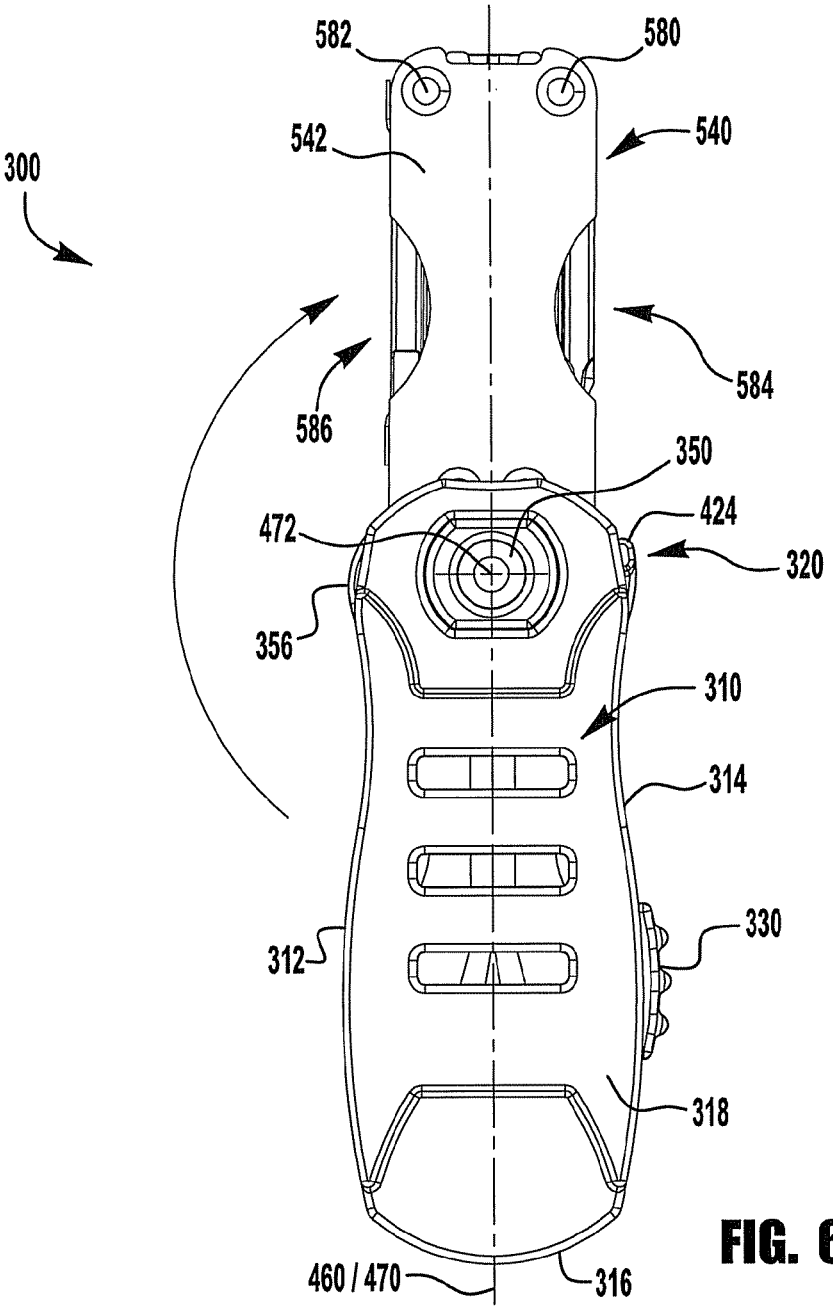

FIGS. 4A-6B illustrate the rotation of the tool portion 540 relative to the body portion 310 and about an axis of rotation 472. As illustrated in FIGS. 4A-4B, the longitudinal axis 470 of the tool portion 540 is substantially parallel to and aligned with the longitudinal axis 460 of the body portion 310 when the tool portion is in the retracted position. As illustrated in FIGS. 5A-5B, the tool portion 540 is rotated relative to the body portion 310 and out of the cavity 720 in the body portion such that the angle between the longitudinal axis 470 of the tool portion and the longitudinal axis 460 of the body portion is about 90 degrees. As illustrated in FIGS. 6A-6B, the longitudinal axis 470 of the tool portion 540 is substantially parallel to and aligned with the longitudinal axis 460 of the body portion 310 when the tool portion is in the extended position. The tool portion 540 may be rotated approximately 180 degrees from the retracted position shown in FIGS. 4A-4B to the extended position shown in FIGS. 6A-6B.

Referring to FIGS. 4A-4B, when the tool portion 540 is in the retracted position, the outer portion 356 of the attachment member 320 extends outward from the body portion 310 and is accessible for fastening the portable tool 300 to the second device 430. An opening 332 disposed between the outer portion 356 of the attachment member 320 and the body portion 310 provides a space or area for fastening the portable tool 300 to the second device 430. As illustrated in FIG. 4A, the space provided by the opening 332 is bounded by the proximal end 326 of the body portion 310 and the outer portion 356 of the attachment member 320 such that the second device 430 is prohibited from coming unfastened from the portable tool 300. Furthermore, the opening 332 may be a variety of shapes and sizes to permit fastening a variety of objects having different sizes and shapes to the portable tool 300.

Figure 3A:
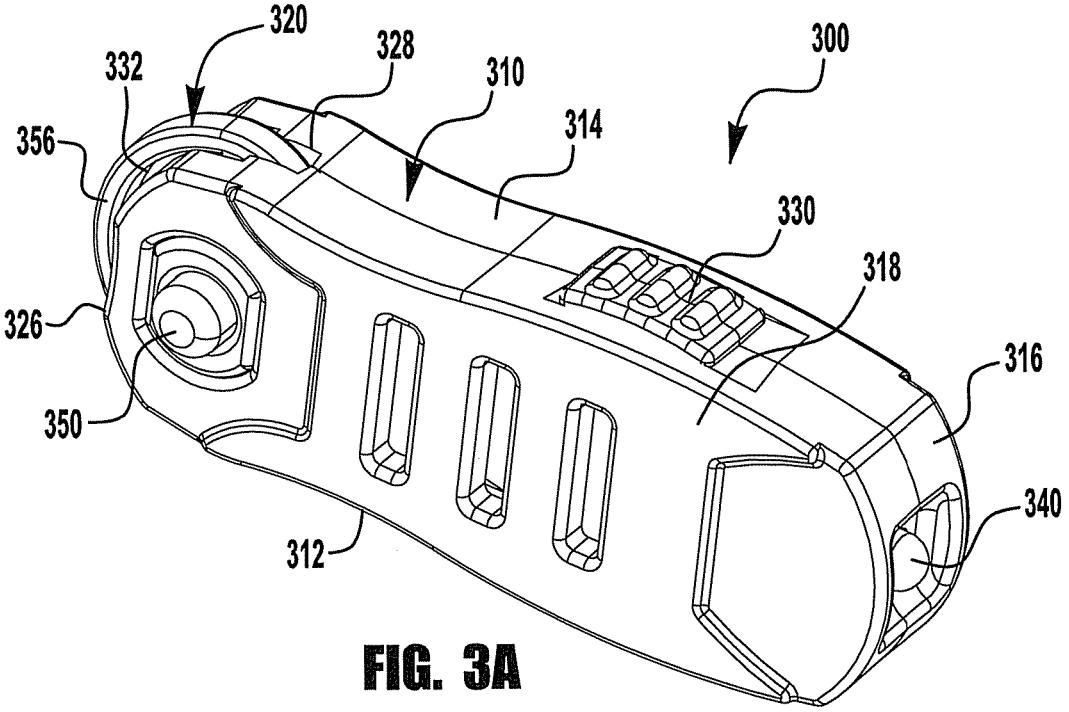
FIGS. 3A and 3B are perspective views of a portable tool according to another embodiment of the present application.
Figure 3B:
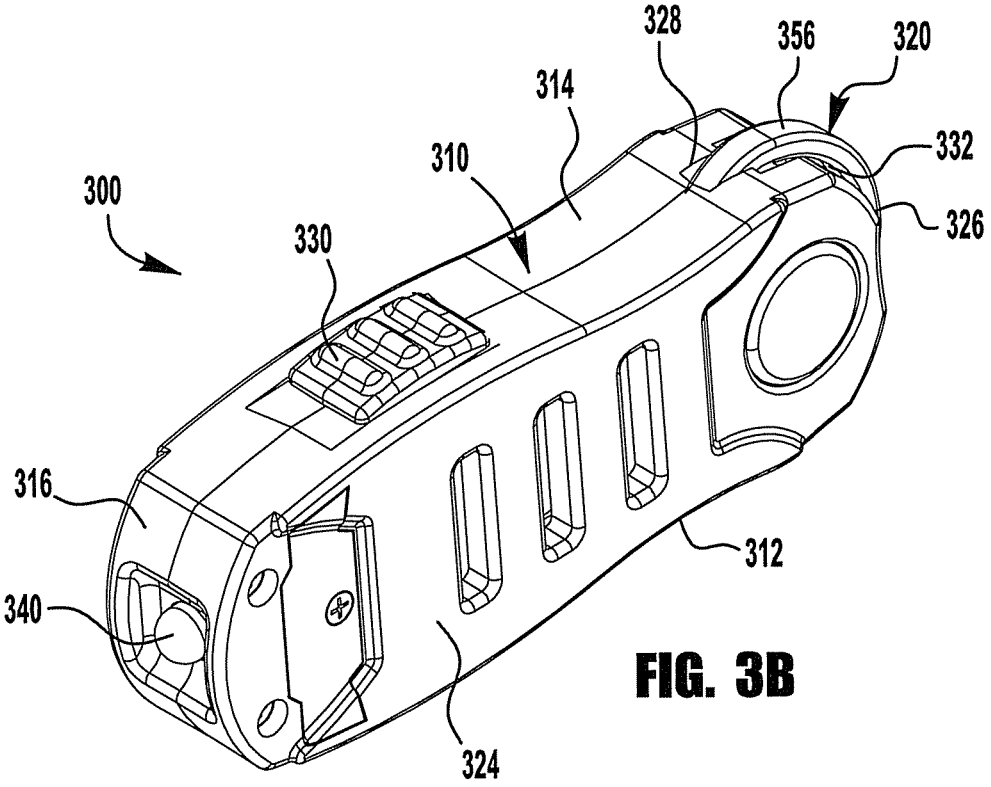

As illustrated in FIGS. 5A-5B, the space 522 between the attachment member 320 and the tool portion 540 is exposed as the tool portion is rotated relative to the body portion 310 to permit removal of the second device 430 from the portable tool 300. As illustrated in FIGS. 4A-6B, the outer portion 356 of the attachment member 320 retracts into the body portion 310 or handle of the portable tool 300 as the tool portion 540 rotates relative to the body portion. An opening 328 in the second longitudinal side 314 of the body portion 310 provides access for the outer portion 356 to retract into the body portion. As can be seen in FIGS. 3A-3B and 8, the opening 328 is a portion of the opening 428 in the first longitudinal side 312 and the proximal end 326 of the body portion 310. However, in other embodiments, the opening 328 may be a separate opening from the opening 428.

In the exemplary embodiment of FIGS. 3A-8, the angle A is about 20 degrees and the angle B is about 160 degrees giving a release range of about 140 degrees. In the alternative, this embodiment can be modified so that virtually any of the different A values, B values, and release ranges discussed above could be used.

As the outer portion 356 of the attachment member 320 is retracted into the body portion 310, the space or area between the outer portion and the proximal end 326 of the body portion 310 is decreased or made smaller. As are result, the second device 430 is automatically released from the portable tool 300 as the tool portion 540 rotates relative to the body portion 310 and the outer portion 356 of the attachment member 320 retracts into the body portion or handle of the portable tool. When the tool portion 540 is in the extended position shown in FIGS. 6A-6B, the outer portion 356 of the attachment member 320 is retracted into the body portion 310 such that it is substantially hidden by the body portion and the tip 424 is not gripped by a user while using the tool. As such, the second device 430 is prohibited from being fastened to the portable tool 300 when the tool portion 540 is in the extended position.

As illustrated in FIGS. 5A-7B, the tool portion 540 includes a first set 584 and a second set 586 of tools. The first set 584 and the second set 586 of tools are disposed between the first plate 542 and a second plate 544 of the tool portion 540. Furthermore, the first set 584 and the second set 586 of tools are rotatably coupled to the first and second plates 542 and 544 with fasteners 580 and 582, respectively. As such, the first set 584 and the second set 586 of tools are configured to rotate about the fasteners 580 and 582 from a retracted position to an extended position.

As illustrated in FIGS. 7A-8, the first set 584 of tools comprises a first tool 754 and a second tool 756 and the second set 586 of tools comprises a first tool 750 and a second tool 752. As shown, the first set 584 of tools comprises Phillips Head screwdrivers, with the first tool 754 being a #2 Phillips and the second tool 756 being a #0 Phillips. The second set 586 of tools comprises Flat Head screwdrivers, with the first tool 750 being a 3/16 inch Flat Head and the second tool 752 being a 3/32 inch Flat Head. Furthermore, as illustrated in FIGS. 5A, 7A, and 8, the first tools 750 and 754 each comprise a groove or cavity for receipt of the respective second tool 752 and 756. As such, when the first tool 750 or 754 is in the extended position, the corresponding second tool 752 or 756 seats within the cavity of the first tool.

It should be noted that the screwdrivers are shown merely as an example of a tool that may be included with the portable tool. Other types of tools may be included, such as, for example, a knife, ice pick, can opener, bottle opener, nail file, flashlight, corkscrew, scissors, hook, cigar cutter, pliers, wrench, divot repair tool, USB device, or the like. Also, the tool portion may include more or less tools than those shown. For example, the tool portion may comprise one, three, four or five sets tools with each set having one or more tools. Also, more or less fasteners may be used to rotatably couple one or more tools to the tool portion. Again, virtually any of the other tool portions in the patents incorporated by reference could be used, in the alternative.

Figure 7B:
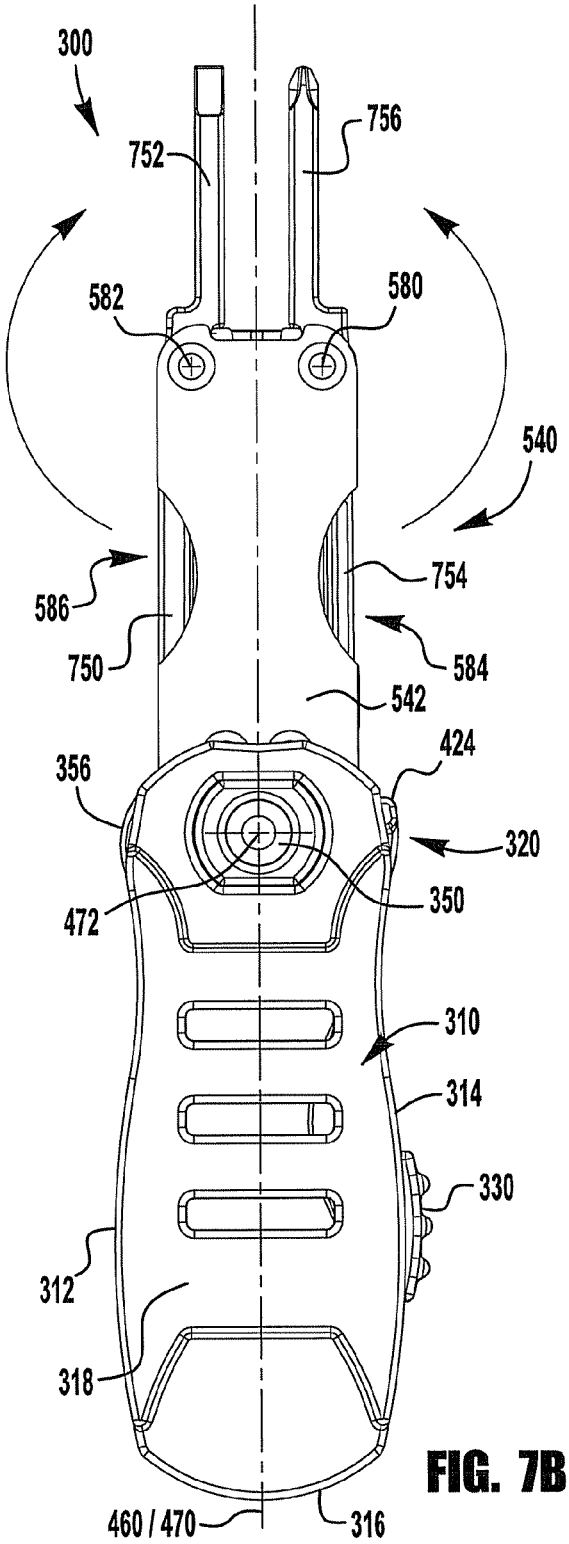

FIGS. 5A-6B illustrate the first set 584 and the second set 586 of tools in the retracted position in which they are stored between the first plate 542 and the second plate 544 of the tool portion 540. FIGS. 7A-7B illustrate the second tools 752 and 756 in an extended position. As shown, the second tools 752 and 756 are rotated relative to the first plate 542 and the second plate 544 and about the fasteners 580 and 582 in the direction shown by the arrows from the retracted position to the extended position. In the extended position, the second tools 752 and 756 are substantially parallel to the longitudinal axis 470 of the tool portion 540 of the portable tool 300. Similarly, the first tools 750 and 754 may be rotated into the extended position such that they are substantially parallel to the longitudinal axis 470 of the tool portion 540 of the portable tool 300.

Furthermore, FIGS. 7A-7B illustrate the tool portion 540 of the portable tool 300 in the extended position. As such, the second tools 752 and 756 are also parallel to the longitudinal axis 460 of the body portion 310 of the portable tool 300. As such, the tool portion 540 and second tools 752 and 756 extend from an end of the body portion 310 or handle of the portable tool 300 such that the portable tool resembles other common tools, such as, for example, a screwdriver, knife, pick, or other like. Furthermore, the body portion 310 of the portable tool 300 provides a rigid and sturdy handle for the user to grip when using the tools of the tool portion 540. In this regard, the portable tool 300 also has the feel of such common tools and is able to withstand the torque and prying forces applied to the handle of such tools. However, the tools of the tool portion 540 may be used when the tool portion is at any angle relative to the body portion 310 and the tools of the tool portion are exposed for use.

As illustrated in FIG. 8, the tool portion 540 includes one or more spring bars 870. The spring bars 870 are biasing members arranged and configured to hold one or more of the tools of the tool portion 540 in the extended and/or retracted position. Furthermore, the first plate 542 and the second plate 544 of the tool portion have notches or cut outs that permit the user to grasp the tool of the tool portion 540 and rotate the tool into position, e.g., the extended position.

The portable tool 300 also comprises a locking mechanism for locking the tool portion 540 in position relative to the body portion 310. As illustrated in FIG. 8, the locking mechanism includes a first cap 888, a button 350 having protrusions 820, a spring 830, and a second cap 840. The first cap 888 has a channel 884 and a cylindrical body portion 886 with longitudinal notches 850. The tool portion 540 and the attachment member 320 have openings sized and shaped to receive the cylindrical body portion 886 of the first cap 888 such that the tool portion and the attachment member rotate about the cylindrical body portion. The button 350 is received within the channel 884 of the first cap 888 and the protrusions 820 are received in the longitudinal notches 850 of the first cap. As such, the button 350 is permitted to move back and forth in a longitudinal direction within the channel 884 of the first cap 888. The spring 830 applies a force against the second cap 840 to bias the button 350 toward the first cap 888. The interaction of the protrusions 820 of the button 350 and the longitudinal notches 850 of the first cap 888 hold the button in an extended position (i.e., not depressed).

When the button 350 is in the extended position, the protrusions 820 of the button are received in notches 880 of the first plate 542 of the tool portion 540, notches 882 of the inner portion 854 of the attachment member 320, and notches 890 of the central member 854 of the tool portion. Furthermore, when the button 350 is in the extended position, the longitudinal notches 850 of the first cap 888 prohibit the button and protrusions 820 from rotating about the axis of rotation 472. As such, the tool portion 540 and the attachment member 320 are locked in position and prohibited from rotating about axis of rotation 472.

When the button 350 is depressed, the button is moved toward the second cap 840 and the protrusions 820 are moved out of the notches 880, 882, and 890 to permit rotation of the tool portion 540 and the attachment member 320 relative to the body portion 310. When the tool portion 540 and the attachment member 320 are rotated 180 degrees, the notches 880, 882, and 890 are again aligned with the protrusions 820 of the button 350 and the spring 830 forces the button and protrusions into the extended position to lock the tool portion and the attachment member in position. As such, the locking mechanism of the portable tool 300 may be configured to lock the tool portion 540 in the retracted and extended positions relative to the body portion 310, and freely move therebetween. In some embodiments, there is sufficient friction between the tool portion and the body portion that the tool portion will stay in a position between fully retracted and fully extended to facilitate use of the tool in non-extended configurations. In the alternative, there might be very little friction between the two, facilitating the tool portion being automatically extended or assisted into the fully extended position. However, in still other embodiments, the locking mechanism of the portable tool 300 may be configured to the lock the tool portion 540 in any number of positions relative to the body portion 310. For example, the notches 880, 882, and 890 may be located at various angles such that the tool portion 540 is locked at a variety of angles relative to the body portion 310, e.g., locked at 0 degrees (fully retracted), 90 degrees, and 180 degrees (fully extended).

As illustrated in FIGS. 7A and 8, a biasing mechanism 730 is disposed within the cavity 720 of the body portion 310. As illustrated, the biasing mechanism 730 is a leaf spring, but a variety of biasing mechanisms may be used, such as a coil spring, rotational spring, pusher, or the like. The biasing mechanism 730 biases or moves the tool portion 540 out of the cavity 720 of the body portion 310. For example, when the user actuates the locking mechanism to release the tool portion 540 from the retracted position, the biasing mechanism 730 biases or moves the tool portion 540 out of the cavity 720 such that it is at least partially exposed. As such, a user of the portable tool 300 is able to easily grasp the tool portion 540 to rotate the tool portion relative to the body portion 310 and into the desired position.

As illustrated in FIGS. 3A and 3B, the portable tool 300 includes a light 340 at a distal end 316 of the body portion 310. As shown, the light 340 is a light emitting diode (LED), but other lamps capable of illuminating a work area may be used. Batteries for the light 340 may be stored within the body portion 310 of the portable tool 300. A switch 330 disposed on the second longitudinal side 314 of the body portion 310 is configured to electrically connect/disconnect the batteries and the light 340. In other embodiments, the portable tool comprises more or fewer lights located at various locations on the body portion 310 and may have one or more switches for actuating the one or more lights. The portable tool of the present application may also comprise one or more scales, such as, for example, ¼ inch and 5 mm scales, on the body portion for measuring objects.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, the body portion may form a water-proof container for the tools to assist in the prevention of the formation of rust. The body portion may be formed of tough plastic or other tough material resistant to rotation while the tools may be formed of metal. The body portion may be coated with a rubber or other gripping compound to promote better gripping by a user. The portable tool may be adapted for different known purposes such as car repair, tire repair, bicycle repair or other mechanical repair. Additionally, the steps of methods herein may generally be performed in any order, unless the context dictates that specific steps be performed in a specific order. Therefore, the invention in its broader aspects is not limited to the specific details, representative apparatus and methods, and illustrative examples shown and described. Accordingly, departures may be made from such details without departing from the spirit or scope of the applicant's general inventive concept.

We claim:

1. A portable tool, comprising:

a body portion having a cavity;

a tool portion coupled to the body portion and having one or more tools, wherein the tool portion is configured to rotate about an axis of rotation and relative to the body portion from a first position in which the tool portion is stored within the cavity of the body portion to a second position in which the longitudinal axis of the tool portion is substantially parallel to the longitudinal axis of the body portion; and an attachment member for fastening the portable tool to a second device, wherein the attachment member is operatively coupled to the tool portion and rotates with the tool portion about the axis of rotation and relative to the body portion; and wherein rotating the tool portion relative to the body portion exposes a space between the attachment member and the tool portion that permits release of the second device from the portable tool and attachment of the second device to the portable tool; and wherein the attachment member comprises an inner portion and outer portion and the outer portion comprises a curved portion that extends outward from the body portion and at least partially circumferentially surrounds the inner portion.

2. The portable tool according to claim 1, wherein rotating the tool portion relative to the body portion retracts the attachment member into the body portion such that the second device is automatically released from the portable tool.

3. The portable tool according to claim 1, wherein rotating the tool portion relative to the body portion moves a tip of the attachment member from the body portion to permit removal of the second device from the portable tool.

4. The portable tool according to claim 1, wherein the second device is first permitted to be removed from the portable tool when the tool portion is rotated relative to the body portion and the angle between the longitudinal axis of the tool portion and the longitudinal axis of the body portion is between about 15 and 25 degrees.

5. The portable tool according to claim 1, wherein rotating the tool portion from the second position and towards the first position exposes the attachment member to permit positioning of the second device into the space between the attachment member and the tool portion.

6. The portable tool according to claim 1, wherein rotating the tool portion from the second position and towards the first position exposes a tip of the attachment member to permit hanging the second device onto the tip.

7. The portable tool according to claim 1, wherein the attachment member is exposed to permit positioning of the second device into the space between the attachment member and the tool portion when the tool portion is rotated relative to the body portion and the angle between the longitudinal axis of the tool portion and the longitudinal axis of the body portion is between about 155 and about 165 degrees.

8. The portable tool according to claim 1, wherein the attachment member is retracted into the body portion such that an exposed portion of the attachment member is no longer large enough to permit fastening the second device to the portable tool when the angle between the longitudinal axis of the tool portion and the longitudinal axis of the body portion is greater than about 165 degrees.

9. The portable tool according to claim 1, wherein the portable tool is configured such that the second device is automatically releasable from the portable tool when the tool portion is rotated relative to the body portion and the angle between the longitudinal axis of the tool portion and the longitudinal axis of the body portion is between about 20 and 160 degrees.

10. The portable tool according to claim 1, wherein the outer portion of the attachment member at least partially circumferentially surrounds an end of the tool portion.

11. The portable tool according to claim 1, wherein the inner portion operatively couples the outer portion of the attachment member to the tool portion.

12. The portable tool of claim 11, wherein the outer portion of the attachment member extends outward from the tool portion proximate an end of the tool portion rotatably coupled to the body portion.

13. The portable tool of claim 11, wherein the outer portion of the attachment member extends outward from the inner portion of the attachment member and then curves to circumferentially surround an end of the tool portion rotatably coupled to the body portion.

14. The portable tool according to claim 1, wherein the space between the attachment member and the tool portion is between a distal end of the attachment member and a longitudinal side of the tool portion.

15. The portable tool according to claim 1, wherein the one or more tools comprise a plurality of tool sets with each tool set comprising at least a first tool and a second tool.

16. The portable tool according to claim 1, wherein rotating the tool portion relative to the body portion retracts the attachment member into the body portion such that the second device is automatically released from the portable tool; and wherein rotating the tool portion relative to the body portion moves a tip of the attachment member from the body portion to permit removal of the second device from the portable tool.

17. The portable tool according to claim 16, wherein the second device is first permitted to be removed from the portable tool when the tool portion is rotated relative to the body portion and the angle between the longitudinal axis of the tool portion and the longitudinal axis of the body portion is between about 15 and 25 degrees;

wherein rotating the tool portion from the second position and towards the first position exposes the attachment member to permit positioning of the second device into the space between the attachment member and the tool portion;

wherein rotating the tool portion from the second position and towards the first position exposes a tip of the attachment member to permit hanging the second device onto the tip;

wherein the attachment member is exposed to permit positioning of the second device into the space between the attachment member and the tool portion when the tool portion is rotated relative to the body portion and the angle between the longitudinal axis of the tool portion and the longitudinal axis of the body portion is between about 155 and about 165 degrees;

wherein the attachment member is retracted into the body portion such that an exposed portion of the attachment member is no longer large enough to permit fastening the second device to the portable tool when the angle between the longitudinal axis of the tool portion and the longitudinal axis of the body portion is greater than about 165 degrees;

wherein the portable tool is configured such that the second device is automatically releasable from the portable tool when the tool portion is rotated relative to the body portion and the angle between the longitudinal axis of the tool portion and the longitudinal axis of the body portion is between about 20 and 160 degrees; and wherein the attachment member comprises a curved portion that extends outward from the body portion and at least partially circumferentially surrounds an end of the tool portion.

* * * * *